United States Patent [19]

Harms

[11] Patent Number: 4,500,123

[45] Date of Patent: Feb. 19, 1985

[54] APPARATUS AND METHOD FOR LOCKING DOORS

[75] Inventor: Orville L. Harms, Boulder, Colo.

[73] Assignee: Timpte Industries, Inc., Denver, Colo.

[21] Appl. No.: 516,473

[22] Filed: Jul. 22, 1983

[51] Int. Cl.[3] ..... E05C 19/18

[52] U.S. Cl. ..... 292/259 A

[58] Field of Search ..... 292/259, 260, 302; 70/417; 312/216

[56] References Cited

U.S. PATENT DOCUMENTS

| | | | |
|---|---|---|---|
| 623,877 | 4/1899 | Breneman | 292/263 |
| 1,707,694 | 4/1929 | Torrence | 292/259 X |
| 2,015,248 | 9/1935 | Williams | 70/417 X |
| 3,656,788 | 4/1972 | Emery | 292/259 R X |
| 3,718,014 | 2/1973 | Delgadillo | 70/417 X |
| 3,736,016 | 5/1973 | Garvey et al. | 292/281 |
| 3,809,417 | 5/1974 | Craig | 292/259 |
| 3,820,662 | 6/1974 | Steers | 211/5 |
| 4,078,836 | 3/1978 | Wilson | 292/259 |
| 4,262,503 | 4/1981 | Kuebler | 292/259 R X |
| 4,300,369 | 11/1981 | Besecker | 70/54 |

*Primary Examiner*—Richard E. Moore

*Attorney, Agent, or Firm*—Sheridan, Ross & McIntosh

[57] ABSTRACT

A locking means for locking the rear doors of a truck trailer in closed position while providing suitable resistance to unauthorized entry. First and second pipes are mounted in an aligned relationship on the rear doors of a truck trailer and a third pipe is inserted into the first and second pipes. A hollow elongated body covers a depending segment secured to the third pipe and locking means are attached to the segment. The third pipe has a non-connected pipe housed therein which pipe is readily rotatable and functions to prevent the complete sawing of the third pipe.

19 Claims, 5 Drawing Figures

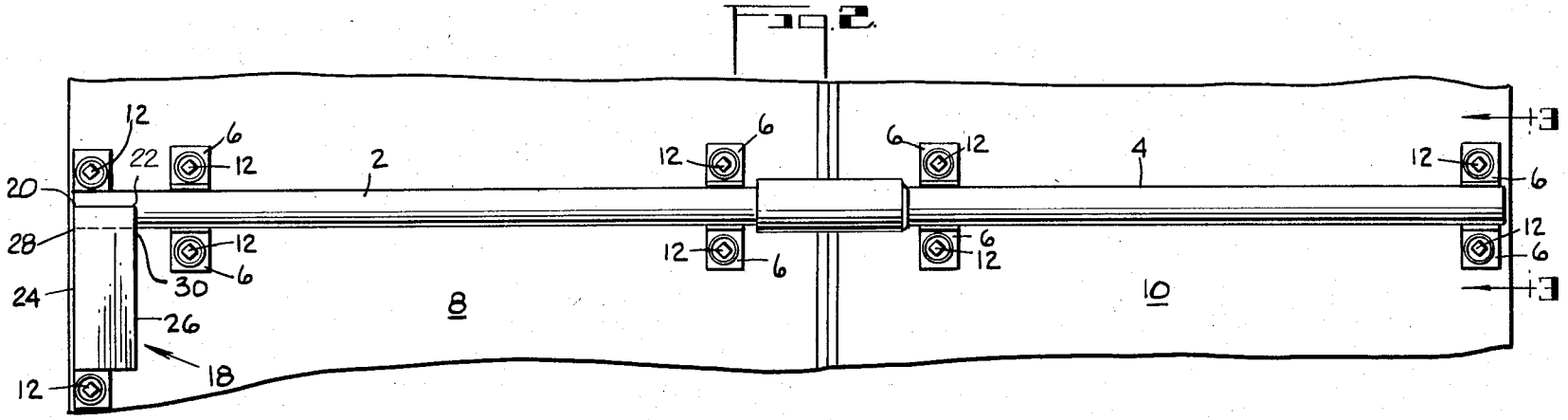
E
E
6
12
4
10
8
2
22
30
26
18
20
28
24
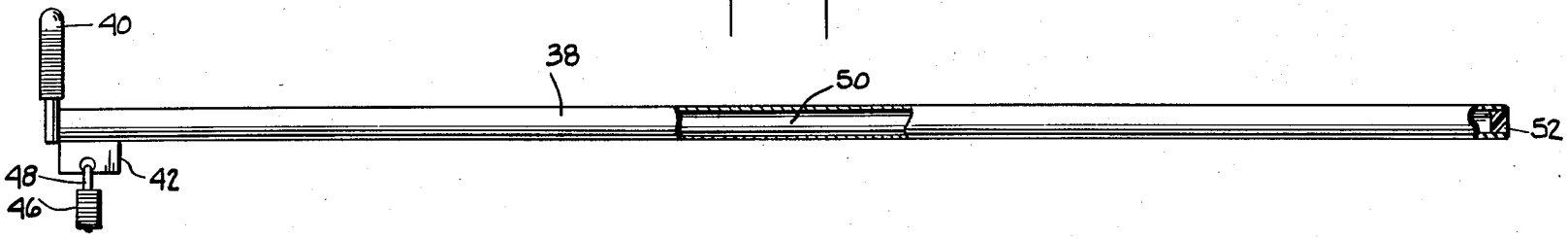
52
50
38
40
42
48
46
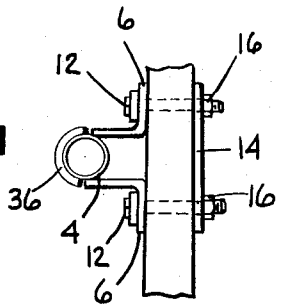
16
14
6
12
4
36
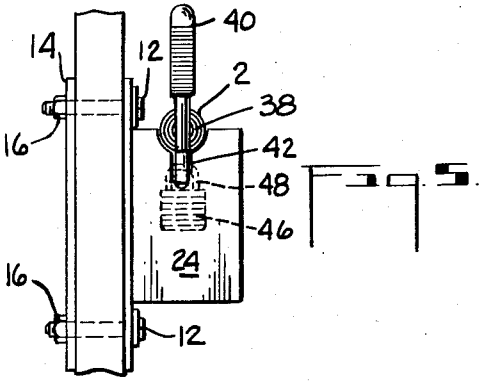
40
2
38
42
48
46
24
12
14
16

APPARATUS AND METHOD FOR LOCKING DOORS

FIELD OF INVENTION

This invention is directed to apparatus and method for locking doors and more particularly to apparatus and method for locking doors with means that is exposed to the outside and must provide a hinderance to being easily opened. The invention is more specifically directed to apparatus and method for locking the rear doors of truck trailers such as those that are left at construction sites and have valuable equipment stored therein.

BACKGROUND OF THE INVENTION

The problem for providing adequate protection for valuable equipment that is necessarily stored in truck trailers at construction sites has existed for many years. Numerous devices have been designed and used with and without some success. One such device is in U.S. Pat. No. 3,736,016 wherein a cover is provided and the padlock is inside the cover. Another similar device is in U.S. Pat. No. 4,300,369. While these devices do provide some protection, they use only the normal connections of the locking device to the rear doors of the trailer. U.S. Pat. Nos. 3,656,788, 3,809,417 and 4,078,836 disclose means for locking doors which employ some type of telescoping members. However, the locking means disclosed in these patents would not be readily adaptable to be mounted on the outside surface of the rear doors of a truck trailer. U.S. Pat. No. 3,820,662 discloses a locking means for a bicycle wherein a cable is secured at one end in a tube so as to resist any attempt to saw completely through the tube.

BRIEF DESCRIPTION OF THE INVENTION

This invention discloses locking means that may be readily mounted on the rear doors of a truck trailer which locking means provides resistance to someone trying to break into the trailer. First and second metal pipes are secured to the rear doors so that the pipes are in alignment and extend for substantially the full width of each door. One of the pipes is provided with a metal cover for covering the adjacent ends of the pipes. A third metal pipe is inserted into the interior of the first metal pipe and extends entirely through the first pipe and almost entirely through the second pipe. An elongated hollow metal body is welded to the first pipe adjacent the end opposite to the covered end and has a length greatly exceeding its width. The elongated hollow metal body has means for securing it to the first door. The end of the first pipe and the elongated hollow metal body have means for receiving a metal plate secured to the third pipe so that the metal plate is located within the elongated hollow metal body. The metal plate is provided with an opening through which the shackle of a padlock extends so that the third pipe cannot be removed from its position inside the first and second pipes. A fourth metal pipe is inserted into and sealed within the third metal pipe before the third pipe is inserted into the first and second pipes but is not connected thereto. This fourth metal pipe provides resistance to a saw blade since it will be readily rotated by a saw blade but not cut thereby.

It is an object of this invention to provide locking means for the rear doors of a truck trailer which locking means provide significant resistance to unauthorized opening of the doors.

It is another object of this invention to provide such locking means in a manner that will not present an undue burden for the routine use of the rear doors.

It is another object of this invention to provide such locking means in a manner that they may be readily available for authorized use.

The foregoing and other objects, features, and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

BRIEF DESCRIPTION OF THE DRAWINGS

FIG. 2 is a front elevation of the components which are secured to the rear doors;

FIG. 3 is an end view of FIG. 2;

FIG. 4 is a front elevation partially in cross-section and showing the rotatable pipe in position; and FIG. 5 is an end view of the assembled locking means.

DETAILED DESCRIPTION OF THE INVENTION

Figure 1:
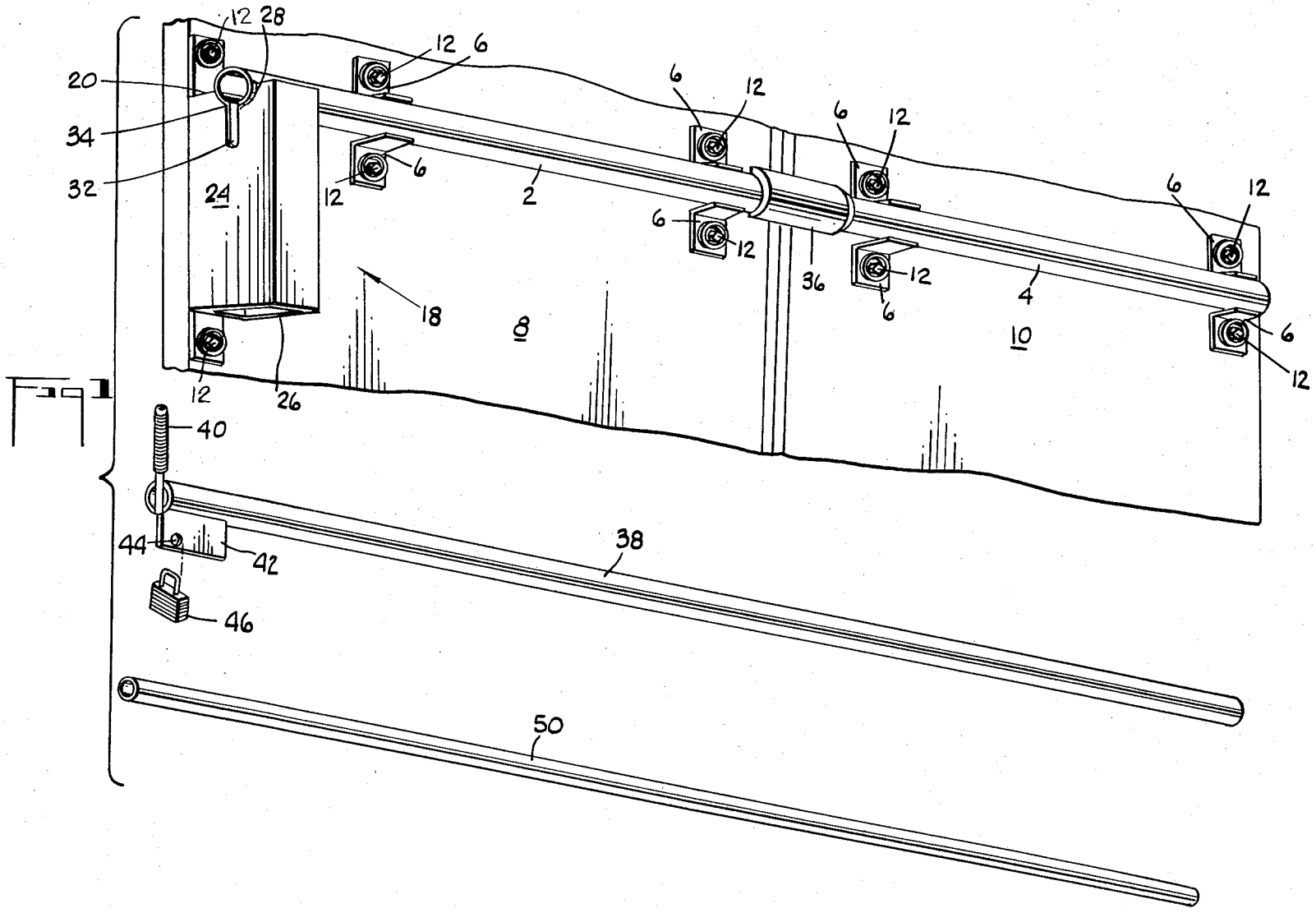
FIG. 1 is a perspective view showing the components of the locking means of this invention.

In FIG. 1, there is illustrated the main components of the locking means of this invention. A first pipe 2 and a second pipe 4 are held in position by being secured to a plurality of 90° angles 6 such as by welding. As illustrated in FIG. 3, angles 6 are secured to the rear doors 8 and 10 by headed threaded bolts 12 passing through an opening in the angles and then through doors 8 and 10. A plate 14 having a pair of openings through which the bolts 12 pass is positioned adjacent the inner surface of the rear doors 8 and 10. Nuts 16 engage the threaded bolts 12 and these are adjusted to bring the angles 6 and the plates 14 into firm engagement with the adjacent surfaces of the doors 8 and 10. The connection between the nut 16 and bolt 12 is such that after the firm engagement is made, further rotation of the bolt 12 results only in the rotation of the nut. This is true in both directions of rotation so that the connection cannot be loosened.

An elongated hollow body 18 is secured to the door 8 in a similar manner. The top edges 20 and 22 of the sides 24 and 26 of the body 18 are provided with semi-circular cutouts 28 and 30. The outer surface of one end of the pipe 2 is nested in these cutouts 28 and 30 and secured thereto, such as by welding. A notch 32 extends from the bottom portion of the semi-circular cutout 28 and a notch 34 is cut out of the end of the pipe 2 for a purpose to be discussed below. Also illustrated in FIG. 1 is a cover 36 which is welded to pipe 4 and extends therefrom so as to also cover the end of pipe 2 when the doors 8 and 10 are in a closed position.

The next component of the locking means is a pipe 38 which has an outer diameter less than the inner diameter of the pipes 2 and 4 so that the pipe 38 may be inserted into the pipes 2 and 4. The pipe 38 has a length slightly less than the combined lengths of pipes 2 and 4. Attached to one end of the pipe 38, such as by welding, is a handle 40 which aids in the insertion of the pipe 38 into the pipes 2 and 4 and the removal therefrom. A plate 42 is secured to the bottom of the pipe 38, such as by welding, so that when the pipe is inserted into the pipes 2 and 4, the plate 42 moves through the notches 32 and 34 and comes to a stop inside the hollow body 18. The plate 42 is provided with an opening 44 so that a padlock 46 may be moved through the bottom of the hollow body 18 and the shackle 48 of the padlock may be passed through the opening 44 and then locked in position. After the padlock 46 is in place, the pipe 38 cannot be withdrawn from the pipes 2 and 4.

Another component of the locking means is a pipe 50 which has an outer diameter smaller than the inner diameter of the pipe 38. The pipe 50 is not attached to the pipe 38 so it is readily rotatable relative thereto. After the pipe 50 has been inserted into pipe 38, a suitable plug 52 is welded to the inner surface of pipe 38. The plug 52 and the handle 40 ensure that the pipe 50 cannot be removed from inside the pipe 38. The pipe 50 has a length less than the length of the pipe 38. The purpose of the pipe 50 is that, if an attempt is made to saw through the pipe 38, the pipe 50 when contacted by the saw will rotate so that the saw cannot cut into the pipe 50 and, therefore, the saw cannot completely cut through pipe 38.

In operation, the pipes 2 and 4 and the hollow body 18 are mounted onto the rear doors 8 and 10. The pipe 38 is then inserted into the pipes 2 and 4 until the plate 42 is within the hollow body 18. A padlock 46 is moved up through the hollow body 18 and the shackle 48 thereof is passed through the opening 44 and then locked in place. It should be noted that the hollow body has a length substantially greater than any cross-sectional dimension so that a tool cannot be readily inserted into the body 18 to break the padlock. In the preferred embodiment, the length is at least twice the width of any side of the hollow body.

It is recognized that the dimensions of the various components may be varied but still be within the spirit of the invention. In one embodiment of the invention, the pipe 2 was 2" metal pipe 31" in length; the pipe 4 was 2" metal pipe 29" in length; the cover 36 was a semi-circular section of $2\frac{1}{2}$" metal pipe 8" in length; the pipe 38 was $1\frac{1}{4}$" metal pipe 59" in length; the pipe 50 was 1" metal pipe 50" in length; the angles were $\frac{1}{4}\times3\times3$" metal 2" in width; the bolts 12 were $\frac{1}{2}\times8$" grade 5 all thread with lock nut; the hollow body 18 was $4\times6$" metal tubing $\frac{1}{4}$" thick and 13" in length; the plate 42 was $\frac{3}{8}\times2$" bar stock $3\frac{3}{4}$" in length; the handle 40 was $\frac{5}{8}$" hot rolled round steel and the padlock 46 was case hardened steel.

While the preferred embodiments of the invention have been described herein, the invention may be otherwise embodied and practiced within the scope of the following claims.

What is claimed is:

1. Apparatus for securing a pair of doors in a closed position comprising:

first and second doors mounted to fixed supports so that said first and second doors can be moved to an opened or closed position;

first and second hollow elongated bodies respectively fixed to the outer surfaces of each of said first and second doors so that said first and second bodies are in alignment when said first and second doors are in the closed position;

a third hollow elongated body open at each end secured to said first door adjacent to and in operative association with an end of said first body to effectively seal one end of said third body;

a fourth hollow elongated body having a cross-sectional area less than the cross-sectional area of said first and second bodies and a length greater than the length of either of said first and second bodies;

portions of said fourth body being located within said first body, said second body and said third body; and locking means associated with said fourth body and located within said third body and adjacent said effectively sealed one end.

2. Apparatus as defined in claim 1 and further comprising:

means having a cylindrical outer surface and a cross-sectional area less than said cross-sectional area of said fourth body loosely positioned within said fourth body so that said means having a cylindrical surface may be readily rotated relative to said fourth body; and means for sealing each end of said fourth body.

3. Apparatus as defined in claim 2 wherein:

each of said first, second and fourth bodies is cylindrical in cross section.

4. Apparatus as defined in claim 1 wherein:

said first, second and fourth bodies are mounted so that their elongated bodies extend in a horizontal direction;

said third body is mounted so that its elongated body extends in a vertical direction; and the upper end portion of said third body having means for receiving said portion of said fourth body.

5. Apparatus as defined in claim 4 wherein:

said means for receiving said portion of said fourth body comprises an arcuate cutout in an upper edge of said third body and a notch in a sidewall of said third body below said cutout; and said portion of said fourth body comprises a segment depending therefrom and having a portion thereof in said notch and the major portion thereof enclosed by said third body.

6. Apparatus as defined in claim 5 wherein:

said locking means comprises an opening in said segment enclosed by said third body; and a lock having a portion extending through said opening.

7. Apparatus as in claim 6 and further comprising:

means for securing said first and second bodies to said first and second doors comprising:

a plurality of 90° angle members having one leg secured to said first or second body so that its other leg is parallel to a first surface of said first or second door;

an opening formed in said other leg;

a plate adapted to be located adjacent to a second surface of said first or second door and having spaced apart openings formed therein;

a headed threaded bolt passing through said opening in said other leg, said first or second door and one of said openings in said plate; and a nut threadedly connected to said bolt and tightened so that said other leg is in secure engagement with said first surface of said first or second door and said plate is in secure engagement with said second surface of said first or second door.

8. Apparatus as defined in claim 7 and further comprising:

lock means associated with said bolt and nut so that they will rotate but not loosen if said head is rotated.

9. Apparatus as defined in claim 6 and further comprising:

means for securing said third body to said first door comprising:

said third body being rectangular in cross section having a length at least twice as long as the width of any of its sides and having one side thereof parallel and adjacent to a first surface of said first door;

a flange extending from the upper and lower ends of said one side also parallel to said first surface of said first door and an opening formed in each of said flanges;

a plate adapted to be located adjacent to a second surface of said first door and having spaced apart openings formed therein;

a headed threaded bolt passing through said opening in one of said flanges, said first door and one of said openings in said plate; and a nut threadedly connected to said bolt and tightened so that said one flange is in secure engagement with said first surface and said plate is in secure engagement with said second surface.

10. Apparatus as in claim 9 and further comprising:

lock means associated with said bolt and nut so that they will rotate but not loosen if said head is rotated.

11. Apparatus as in claim 6 and further comprising:

said fourth body has a length slightly less than the combined lengths of said first and second bodies.

12. Apparatus as in claim 11 and further comprising:

said means having said cylindrical surface has a length slightly less than the length of said fourth body.

13. Apparatus as in claim 12 and further comprising:

cover means secured to the outer surface of one of said first or second bodies adjacent one end thereof;

said cover means having an inner surface for mating with the outer surface of said first and second bodies; and said cover extending away from said one of said first or second bodies and covering the other of said first or second bodies adjacent an end thereof.

14. Apparatus as defined in claim 13 wherein:

said first and second doors are the rear doors of a truck trailer.

15. Apparatus as defined in claim 14 and further comprising:

a handle extending vertically from one end of said fourth body and said handle being secured thereto.

16. A method for securing the rear doors of a truck trailer in a closed position comprising:

mounting first and second hollow elongated bodies on each of said rear doors so that said bodies are in alignment;

inserting a third hollow elongated body into the interior of said first and second bodies;

covering one end of said third body;

locking said covered one end in place;

inserting an elongated body having a cylindrical outer surface into the interior of said third body;

providing said third body with a cylindrical inner surface;

sealing each end of said third body; and allowing free rotation of said body with said cylindrical outer surface on the cylindrical inner surface of said third body.

17. A method as in claim 16 and further comprising:

covering adjacent ends of said first and second bodies.

18. A method as in claim 17 and further comprising:

securing said first and second bodies to said rear door with means that will rotate but not loosen.

19. A method as in claim 18 and further comprising:

providing said third body with a handle that extends vertically from one end of said third body so that said third body may be readily inserted into said first and second bodies and readily removed therefrom.

* * * * *